US008342582B2

(12) United States Patent
Bendel et al.

(10) Patent No.: US 8,342,582 B2
(45) Date of Patent: Jan. 1, 2013

(54) ABSORBER ELEMENT FOR A MOTOR VEHICLE LOCK

(75) Inventors: Thorsten Bendel, Oberhausen (DE); Klaus Götzen, Mülheim (DE); Dieter Meyer, Wolfsburg (DE); Jens Richter, Wolfsburg (DE); Kay-Olaf Loock, Wolfsburg (DE); Kai Schrenke, Walbeck (DE); Wolfgang Hogräfer, Braunschweig (DE)

(73) Assignee: Kiekert AG, Heiligenhaus (DE)

( * ) Notice: Subject to any disclaimer, the term of this patent is extended or adjusted under 35 U.S.C. 154(b) by 0 days.

(21) Appl. No.: 12/997,594

(22) PCT Filed: Jul. 1, 2009

(86) PCT No.: PCT/DE2009/000930

§ 371 (c)(1),
(2), (4) Date: Dec. 11, 2010

(87) PCT Pub. No.: WO2010/000246

PCT Pub. Date: Jan. 7, 2010

(65) Prior Publication Data

US 2011/0089706 A1 Apr. 21, 2011

(30) Foreign Application Priority Data

Jul. 3, 2008 (DE) ..... 10 2008 031 206

(51) Int. Cl.
*E05C 3/06* (2006.01)
*E05C 3/12* (2006.01)

(52) U.S. Cl. ..... 292/216; 292/341.12; 292/DIG. 56

(58) Field of Classification Search ..... 292/201, 292/216, DIG. 56, 341.12
See application file for complete search history.

(56) References Cited

U.S. PATENT DOCUMENTS

| | | | | | |
|---|---|---|---|---|---|
| 1,990,141 | A * | 2/1935 | Seitz | 16/85 |
| 3,331,624 | A * | 7/1967 | Pugh | 292/216 |
| 3,667,791 | A * | 6/1972 | Kazaoka et al. | 292/216 |
| 4,073,519 | A * | 2/1978 | Kurozu et al. | 292/216 |
| 4,130,308 | A * | 12/1978 | Jeavons | 292/216 |
| 4,569,544 | A * | 2/1986 | Escaravage | 292/216 |
| 4,756,563 | A | 7/1988 | Garwood et al. | |
| 4,838,588 | A * | 6/1989 | Hayakawa et al. | 292/216 |
| 4,941,696 | A | 7/1990 | Yamada et al. | |
| 5,106,134 | A * | 4/1992 | Thau | 292/216 |
| 5,727,825 | A * | 3/1998 | Spurr | 292/341.12 |
| 5,758,912 | A * | 6/1998 | Hamada | 292/216 |
| 5,785,365 | A * | 7/1998 | Lorey | 292/216 |
| 7,306,269 | B2 * | 12/2007 | Cetnar et al. | 292/341.12 |
| 7,401,822 | B2 * | 7/2008 | Graute | 292/216 |
| 7,503,598 | B2 * | 3/2009 | Graute | 292/216 |
| 7,780,205 | B2 * | 8/2010 | Graute | 292/216 |
| 7,845,692 | B2 * | 12/2010 | Inan et al. | 292/216 |
| 2009/0224559 | A1 * | 9/2009 | Park | 292/336.3 |

FOREIGN PATENT DOCUMENTS

| | | |
|---|---|---|
| DE | 20 2006 018744 U1 | 2/2007 |
| EP | 1 065 336 A1 | 1/2001 |
| GB | 1 436 996 A | 5/1976 |
| GB | 2 321 928 A | 8/1998 |

* cited by examiner

*Primary Examiner* — Carlos Lugo
(74) *Attorney, Agent, or Firm* — Renner, Otto, Boisselle & Sklar, LLP

(57) ABSTRACT

Device (1) for a motor vehicle lock (2) comprising an inlet (3) for a latch pin (4), wherein the inlet (3) has an entrance region (5) and an end region (6) with at least one damper element (7) which can absorb the contact force from the latch pin (4), wherein the damper element (7) has at least one opening (8), in which at least the rigid insert (9) is disposed against the damper element (7).

20 Claims, 3 Drawing Sheets

ABSORBER ELEMENT FOR A MOTOR VEHICLE LOCK

CROSS-REFERENCE TO RELATED APPLICATIONS

This is a National Stage Application of International Patent Application No. PCT/DE2009/000930, with an international filing date of Jul. 1, 2009, which is based on German Patent Application No. 10 2008 031 206.1, filed Jul. 3, 2008.

BACKGROUND OF THE INVENTION

1. Field of the Invention

The present invention relates to a device for a motor vehicle lock comprising an inlet for a latch pin, wherein the inlet has an entrance region and an end region with at least one damper element. The damper element is suitable for absorbing a contact force originating from the latch pin. In particular, the invention relates to a motor vehicle door lock with a locking mechanism comprising a catch, a pawl, and a latch pin (also called a locking bolt, a striker, etc.) that moves inwardly into a so-called inlet or that cooperates with the catch, and wherein said inlet or said seat comprise at least one such damper element.

2. Brief Description of the Related Art

Such motor vehicle door locks are generally known. The damper element has the task of receiving and holding the latch pin as it moves inward into an inlet, while minimizing noise, and finally the latch pin is held in a latched position. In general, the latch pin and the inlet move with respect to one another. The latch pin is usually secured to the motor vehicle body and the motor vehicle door (with the corresponding motor vehicle lock) is moved toward the latch pin. The inlet may possibly also have the function of leading the latch pin upon entry or exit into the inlet and to lift it into the correct position.

Such damper elements have been found particularly appropriate for reducing noise during the closing of motor vehicle locks. However, there remains a need to further improvements. In addition, it should be ensured that the latch pin in such motor vehicle locks is fixed securely against the inlet or the catch.

BRIEF DESCRIPTION OF THE INVENTION

On this basis, the present invention solves the prior art problems, at least partially. In particular, a device is to be developed that allows for a motor vehicle lock to close and open smoothly and quietly into and out of the locked position while experiencing dynamic and static loads.

These tasks are achieved with a locking device having the features as described herein. Advantageous embodiments of the device are given in the dependent claims. In addition, the description mentions a number of other embodiments of the invention that are also very beneficial.

The inventive device for a motor vehicle lock comprises an inlet for a latch pin, wherein the inlet has an entrance region and an end region with at least one damper element, the damper element can absorb a contact force coming from the latch pin, the damper element has at least one opening, and a rigid insert is disposed in the opening against the damper element.

The invention makes use of the idea that the damper element is itself formed locally using portions that are rigid with respect to other portions of the damper element. Such rigid portions can be used, in particular, for fixing the position or for guiding of the latch pin.

The damper element is generally made of a thermoplastic plastic, in particular, polyurethane (PUR) or rubber. It has, for example, a Shore A hardness of between 60 and 90, preferably about 70.

In contrast, the proposed rigid insert is characterized by a greater hardness and/or a smaller deformation response compared to the damper element (with respect to incoming contact forces).

The opening in the damper element may be formed all the way through the damper element. However, it is preferred that the opening is not formed all the way through. The opening preferably extends substantially parallel to the adjacent latch pin. In principle, the cross-sectional shapes of the opening are adjusted based on the needs. However, in most cases, a round or cylindrical opening is useful. The number of openings in the damper element can also be adjusted. However, between 1 and 3 openings are preferred. Not all of the openings must be implemented with a rigid insert.

The rigid insert is preferably maintained in the opening without additional connecting means. Thus, preferred are form-locking and/or frictional connections, for example a press fit. In this way, it is possible to generate a bulge extending as desired on the top side of the damper element towards the latch pin. Thus, application-specific adjustments can be made with a (standardized) bore and different sizes of the rigid insert.

According to a further embodiment of the device, the opening is a blind bore and the rigid insert is a plastic pin. In this case, it is preferred that the bore has the same or even a slightly smaller diameter than the rigid insert to be positioned in the bore. In this case, this rigid insert is cylindrical in shape and is so inserted into the blind bore that a press fit is formed with the damper element. Here, the plastic pin is advantageously surrounded laterally by the damper element. The plastic used has, in particular, a higher Shore A hardness than the damper element. The Shore A hardness of the plastic pin is preferably at least 20% higher than the Shore A hardness of the damper element, in particular, higher by at least 50% or even 100% than the Shore A hardness of the damper element. The preferred material here is POM (polyoxymethylene) or a similar material.

In addition, it is considered advantageous that the damper element and the rigid insert form a bearing lining for the latch pin. Bearing means, in particular, a connection between the latch pin and the catch encompassing the latch pin in the closed position of the catch. Exactly in this situation, therefore, the section of the damper element with the rigid insert serves as a supporting surface for the bearing. In particular, this facilitates a kind of fixation of the latch pin in the locked position of the bolt so that the relative motion of the catch and the locking pin in this position is reduced or avoided during vehicle operation. In addition, the device can play here a guiding role, for example, to achieve tolerance compensation in the positioning of the latch pin and the catch.

It is also considered advantageous that the rigid insert is laterally positioned with respect to a latched position of the latch pin in the inlet. In other words, in particular, the rigid insert is oriented laterally with respect to the latch pin, in the locked position of the latch pin. The rigid insert and the latch pin lie, e.g., in the same plane, which is perpendicular to the plane defined by the inward movement of the latch pin into the inlet.

The invention is further illustrated below with reference to the figures, which show various preferred embodiments.

DETAILED DESCRIPTION OF THE INVENTION

Figure 1:
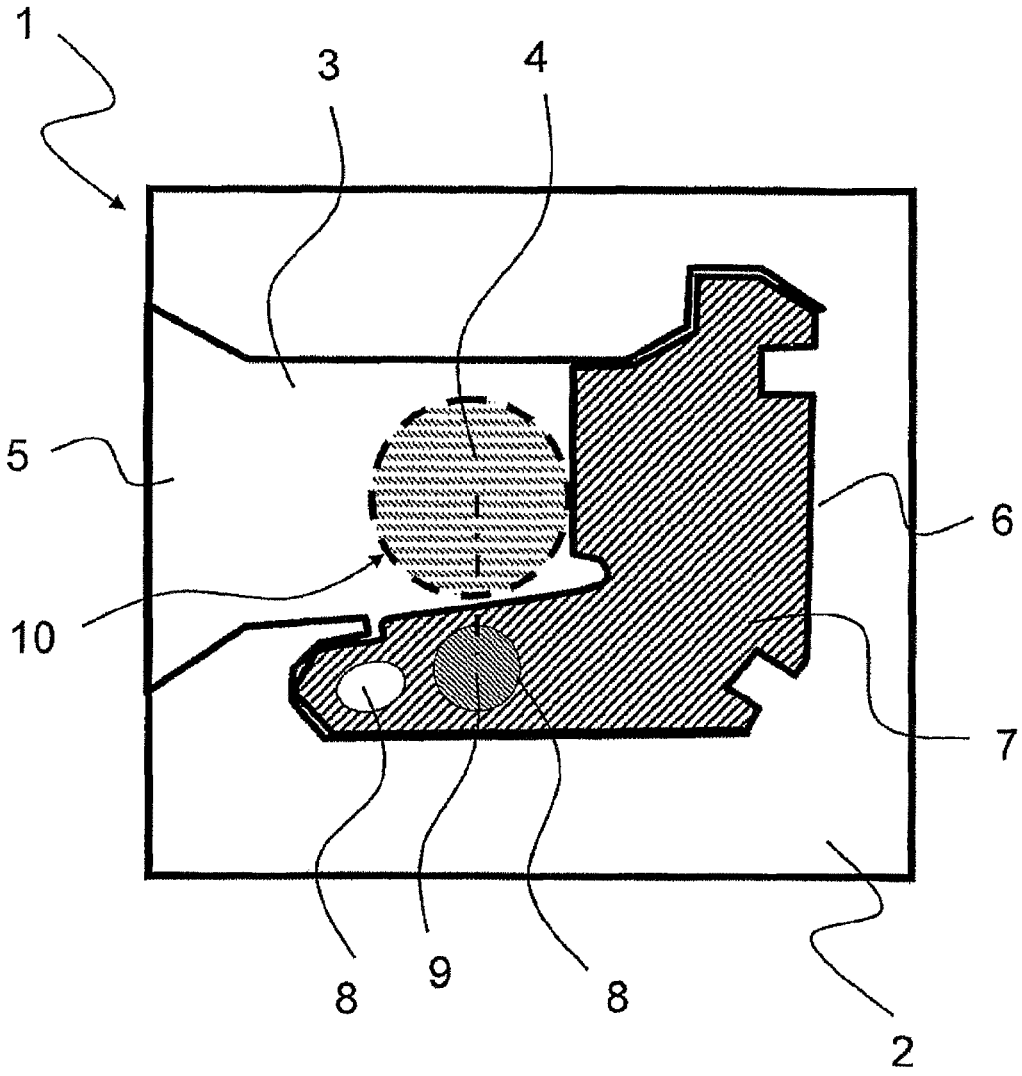
FIG. 1 illustrates a first embodiment of the device for a motor vehicle lock.

FIG. 1 illustrates a first embodiment of the device 1 for a motor vehicle lock 2. The motor vehicle lock 2 forms an inlet 3 for the indicated latch pin 4. With reference to FIG. 1, the inlet 3 passes from the left side (entrance region 5 for the latch pin 4) into the inner area of the motor vehicle lock 2 up to the end region 6. In the end region 6, disposed is an L-shaped damper element 7, which can take up a contact force originating from the latch pin 4. The damper element 7 has, at the bottom and in the side area of the inlet 3 between the entrance region 5 and the end region 6, several inboard openings 8. A rigid insert 9 is inserted into the opening 8. In the illustrated embodiment, the opening 8 with the rigid insert 9 is formed in the style of a bore, which is positioned in vertical alignment with respect to the latch pin 4 being installed at the shorter L-leg of the damper element 7 in the closed position of the locking mechanism (not shown here). The rigid insert 9 is formed as a kind of a plastic pin. The plastic pin has a diameter that corresponds to the diameter of the opening, wherein it is preferred that the connection between the opening and plastic pin is a press fit.

The diameter of the rigid insert is preferably between 3 mm and 5 mm, in particular, from 3.8 mm to 4.2 mm.

In addition, the damper element has one additional opening 8 (here illustrated without an inner insert). The position of the additional opening may also be provided in the region of the damper element 7, which is nearer to the end region 6 of the inlet.

In the illustrated embodiment, the rigid insert 9 is disposed laterally and toward a latched position 10, in which the latch pin 4 is shown. In this way, a bearing lining is formed, which, by means of a rigid insert 7, provides positional stability with respect to the position of the latch pin 4.

Figure 2:
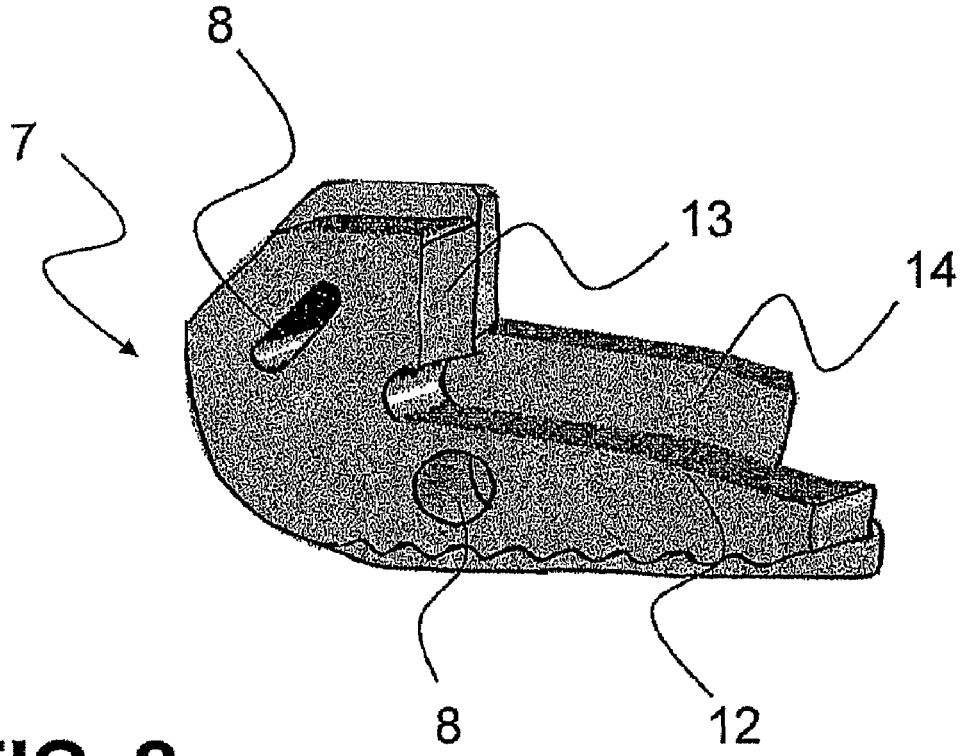
FIGS. 2 and 3 illustrate embodiments of the damper element.
Figure 3:
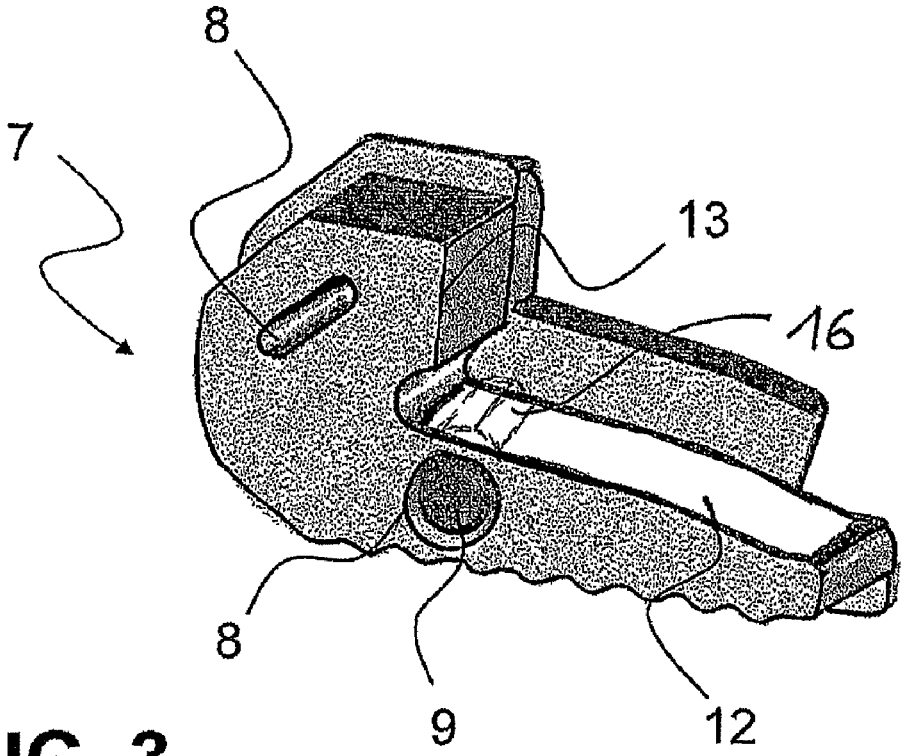

FIGS. 2 and 3 are perspective views of other embodiments of the damper element 7. The damper element 7 is L-shaped with a longer inlet leg 12 and a shorter impact leg 13. In the area of the shorter impact leg 13 an elongated opening 8 is provided without a rigid insert 9. Such rigid insert 9 is formed, however, in the opening 8 disposed in the longer inlet leg 12 (the two figures show this in detail before and after the assembly of both parts). To explain, it should be noted that the damper element 7 is shown as being formed in the back with a contour 14, which allows for the fixing of the damper element 7 in the motor vehicle lock, especially in the inlet 3. Also indicated is a bulge 16.

The rigid insert 9 (pin) is made of POM. In this application, the opening 8 for the rigid insert 9 in the damper element has a diameter of about 4 mm and a depth of about 12.2 mm (blind bore).

The rigid insert 9 has a diameter of between 4 mm and 5 mm. Different diameters allow different vehicles to have custom-adjusted fixation and damping functions of the latch pin in the main catch position. In the event that a kind of a spring lip is provided between the inlet leg and the latch pin (see reference number 15 in FIG. 4), the spring lip can be pretensioned to different extents. The length of the cylindrical rigid insert 9 is, for example, about 12 mm.

Figure 4:
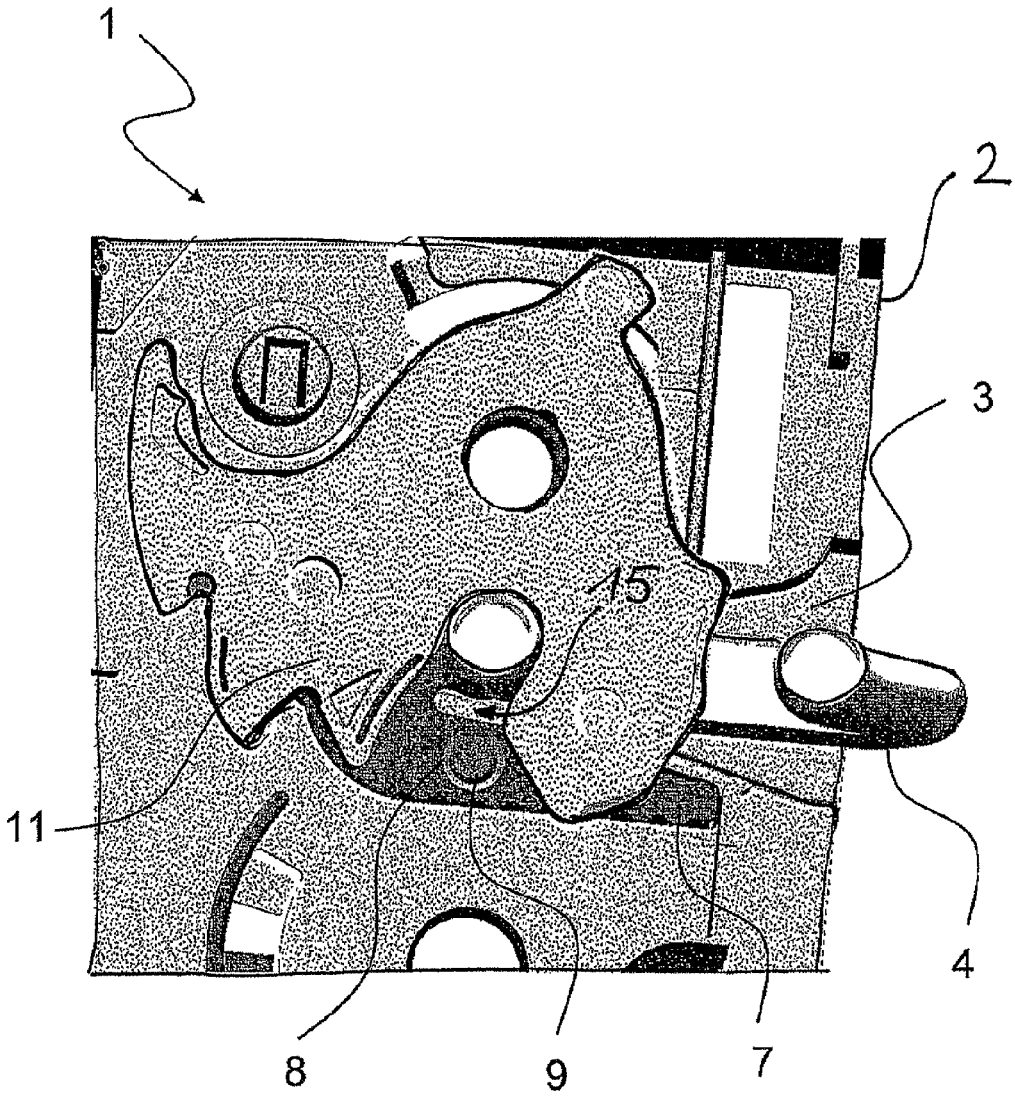
FIG. 4 shows a locked position of the motor vehicle lock, in which the catch holds the latch pin securely in the inlet.

FIG. 4 shows a locked position of the motor vehicle lock 2, in which the catch 11 holds the latch pin 4 securely in the inlet 3. Below the portion of the U-shaped latch pin 4 that is clasped by the catch 11, the damper element 7 can be recognized, which includes the rigid insert 7 in the opening 8.

Reference List

1. Device
2. Motor vehicle lock
3. Inlet
4. Latch pin
5. Entrance region
6. End region
7. Damper element
8. Opening
9. Rigid insert
10. Latched position
11. Catch
12. Inlet leg
13. Impact leg
14. Form contour
15. Spring lip
16. Bulge

The invention claimed is:

1. A device (1) for a motor vehicle lock (2) comprising an inlet (3) for a latch pin (4), wherein said inlet (3) has an entrance region (5) and an end region (6) with a damper element (7) disposed therein, said damper element (7) is configured to absorb a contact force coming from said latch pin (4) when said latch pin (4) is received within said inlet (3), said damper element (7) has at least one opening (8), a rigid insert (9) being disposed in said opening (8) against said damper element (7), prior to said damper element (7) being installed in the lock (2), to fine tune of a cushioning action of said damper element (7) when said latch pin (4) is received in said inlet (3).

2. The device of claim 1, wherein said opening (8) is a blind bore and said rigid insert (9) is a plastic pin.

3. The device of claim 1, wherein said damper element (7) and said rigid insert (9) form a bearing lining for the latch pin (4), whereby said damper element (7) and said rigid insert are adapted to fix the latch pin (4) in a latched position (10).

4. The device of claim 1, wherein said rigid insert (9) is formed laterally to a latched position (10) of said latch pin (4) in the inlet (3), whereby said rigid insert (9) is adapted to stabilize said latch pin (4) in the latched position (10).

5. The device of claim 2, wherein said damper element (7) and said rigid insert (9) form a bearing lining for the latch pin (4), whereby said damper element (7) and said rigid insert are adapted to fix the latch pin (4) in a latched position (10).

6. The device of claim 2, wherein said rigid insert (9) is formed laterally to a latched position (10) of said latch pin (4) in the inlet (3), whereby said rigid insert (9) is adapted to stabilize said latch pin (4) in the latched position (10).

7. The device of claim 3, wherein said rigid insert (9) is formed laterally to a latched position (10) of said latch pin (4) in the inlet (3), whereby said rigid insert (9) is adapted to stabilize said latch pin (4) in the latched position (10).

8. The device of claim 5, wherein said rigid insert (9) is formed laterally to a latched position (10) of said latch pin (4) in the inlet (3), whereby said rigid insert (9) is adapted to stabilize said latch pin (4) in the latched position (10).

9. The device of claim 1, wherein the diameter of said rigid insert (9) is larger than that of said opening (8), whereby a bulge (16) adapted to cushion the latch pin (4) is formed on said damper element (7).

10. The device of claim 9, wherein said bulge (16) is adapted to reduce noise and to absorb impact coming from the latch pin (4).

11. A device (1) for a motor vehicle lock (2), the motor vehicle lock (2) having an inlet (3) for a latch pin (4); the inlet (3) having an entrance region (5) and an end region (6); the device (1) comprising:

a damper element (7) comprising a longer leg (12) and a shorter leg (13), said longer leg (12) having a first opening (8) disposed in a close proximity to a surface of said damper element (7), at which surface the latch pin (4) is adapted to rest against said damper element (7); and a rigid insert (9);

wherein:

said damper element (7) is adapted to be disposed in the inlet (3) and to absorb a contact force coming from the latch pin (4);

said rigid insert (9) is disposed in said first opening (8) against said damper element (7), prior to said damper element (7) being installed in the lock (2), to fine tune of a cushioning action of said damper element (7) when said latch pin (4) is received in said inlet (3); and said rigid insert (9) is a plastic pin having a Shore A hardness that is at least 20% higher than the Shore A hardness of said damper element (7);

whereby said rigid insert (9) is adapted to support the latch pin (4).

12. The device of claim 11, wherein a second opening is adapted to be disposed in said shorter leg (13) and said second opening is elongated.

13. The device of claim 11, wherein said damper element (7) and said rigid insert (9) are adapted to form a bearing lining for the latch pin (4), whereby said damper element (7) and said rigid insert are adapted to fix the latch pin (4) in a latched position (10).

14. The device of claim 11, wherein said rigid insert (9) is adapted to be disposed in said first opening (8) laterally to a latched position (10) of the latch pin (4), whereby said rigid insert (9) is adapted to stabilize the latch pin (4) in the latched position (10).

15. The device of claim 11, wherein the Shore A hardness of said damper element (7) is between 60 and 90.

16. The device of claim 11, wherein said rigid insert (9) is a plastic pin having a Shore A hardness that is at least 50% higher than the Shore A hardness of said damper element (7).

17. The device of claim 16, wherein said rigid insert (9) is a plastic pin having a Shore A hardness that is 100% higher than the Shore A hardness of said damper element (7).

18. A combination of a latch pin (4); a lock (2) for a motor vehicle having a body and a door; and a device (1) for the lock (2); the latch pin (4) being secured to the motor vehicle body; the lock (2) being secured in the motor vehicle door; the lock (2) having an inlet (3) for the latch pin (4); the inlet (4) having an entrance region (5) and an end region (6); and the device (1) comprising:

a damper element (7) disposed in said inlet (3), said damper element (7) comprising a longer leg (12) and a shorter leg (13), said longer leg (12) having an opening (8) disposed in close proximity to a surface of said damper element (7), at which surface the latch pin (4) is adapted to rest against said damper element (7); and a rigid insert (9) disposed in said opening (8) against said damper element (7), prior to said damper element (7) being installed in the lock (2), to fine tune of a cushioning action of said damper element (7) when said latch pin (4) is received in said inlet (3); said rigid insert (9) having a hardness that is higher than the hardness of said damper element (7), whereby said rigid insert (9) supports and stabilizes said latch pin (4) in a latched position (10).

19. A device (1) for a motor vehicle lock (2); the motor vehicle lock (2) having an inlet (3) for a latch pin (4); the inlet (3) having an entrance region (5) and an end region (6); the device (1) comprising: a damper element (7) disposed in the inlet (3) and adapted to absorb a contact force coming from the latch pin (4), said damper element (7) having at least one opening (8);

wherein the improvement comprises:

a rigid insert (9) is disposed in said first opening (8) against said damper element (7), prior to said damper element (7) being installed in the lock (2), to fine tune of a cushioning action of said damper element (7) when said latch pin (4) is received in said inlet (3);

said opening (8) is located in close proximity to a surface of said damper element (7), at which surface the latch pin (4) is adapted to rest against said damper element (7);

the diameter of said rigid insert (9) is larger than that of said opening (8); and the hardness of said rigid insert (9) is higher than that of said damper element (7).

20. The device of claim 19, wherein the improvement further comprises a bulge (16) being formed on said damper element (7) and being adapted to absorb impact coming from the latch pin (4), to cushion the latch pin (4), and to reduce noise.

* * * * *